United States Patent [19]

May

[11] 4,393,847

[45] Jul. 19, 1983

[54] LOW PRESSURE SEALING ARRANGEMENT FOR A FUEL INJECTOR

[75] Inventor: Charles W. May, Cedar Falls, Iowa

[73] Assignee: Deere & Company, Moline, Ill.

[21] Appl. No.: 361,680

[22] Filed: Mar. 25, 1982

[51] Int. Cl.[3] ..... F02M 47/02

[52] U.S. Cl. ..... 123/502; 123/467; 123/387; 123/499; 239/533.5; 239/95; 239/92; 277/3

[58] Field of Search ..... 123/467, 502, 501, 500, 123/506, 497, 499, 385, 387; 239/95, 88, 89, 90, 91, 92, 93, 533.3, 533.4, 533.5; 277/3, 27; 417/385, 318, 498

[56] References Cited

U.S. PATENT DOCUMENTS

| | | | |
|---|---|---|---|
| 2,792,259 | 5/1957 | Shallenberg | 239/90 |
| 3,385,276 | 5/1968 | Reiners | 123/387 |
| 3,951,117 | 4/1976 | Perr | 123/502 |
| 4,134,549 | 1/1979 | Perr | 239/533.4 |
| 4,146,178 | 3/1979 | Bailey | 123/506 |
| 4,235,374 | 11/1980 | Walter et al. | 239/90 |
| 4,250,857 | 2/1981 | Taplin | 239/533.5 |
| 4,281,792 | 8/1981 | Sisson et al. | 239/5 |

FOREIGN PATENT DOCUMENTS

| | | | |
|---|---|---|---|
| 1196663 | 11/1959 | France | 123/499 |

*Primary Examiner*—Charles J. Myhre
*Assistant Examiner*—Carl Stuart Miller

[57] ABSTRACT

A low pressure sealing arrangement for a fuel injector which includes a housing containing a cylindrical barrel having a bore formed therein. Within the bore is positioned an axially movable plunger and piston which form a timing chamber therebetween. An inner surface of the housing cooperates with an outer surface of the barrel to form an annular cavity and a passage connects one end of the annular cavity with the timing chamber. Located within the annular cavity itself is arranged a pressure activated valve which is surrounded by a cylindrical sleeve. The pressure activated valve is spring biased to a closed position and is movable between an open and a closed position to regulate the flow of fluid into the timing chamber. The outer surface of the pressure activated valve cooperates with the inner surface of a cylindrical sleeve to form a first low pressure seal therewith when the valve is in the closed position. In addition, an O-ring positioned at one end of the cylindrical sleeve abuts against a top surface of the annular cavity to form a second low pressure seal when the pressure activated valve is in the closed position. The two low pressure seals prevent leakage of fluid from the timing chamber while permitting rapid reciprocation of the pressure activated valve without exerting an excessive amount of drag thereon.

5 Claims, 3 Drawing Figures

LOW PRESSURE SEALING ARRANGEMENT FOR A FUEL INJECTOR

FIELD OF THE INVENTION

This invention relates to a low pressure sealing arrangement for a fuel injector and more particularly to a low pressure sealing arrangement which reduces the drag forces on a reciprocating valve as it moves between an open and a closed position.

BACKGROUND OF THE INVENTION

Fuel injectors are devices used on internal combustion engines for the delivery of fuel into the cylinder of the engine. The fuel injectors are mechanically driven from the camshaft of the engine, via a rocker arm mechanism, a cam and a cam follower. The mechanical mechanism actuates a plunger which reciprocates within a bore of the fuel injector and in turn actuates a piston also located within the bore. Located between the plunger and the piston is a timing chamber and located between the piston and the nozzle of the fuel injector is a metering chamber. By supplying pressurized fluid to the timing and metering chambers and by controlling the amount of fluid into and out of these chambers by one or more valves, one can control both the timing and the metering of fuel into the combustion chamber of the engine. During the operation of such fuel injectors, there is a buildup of pressure within the timing chamber during a portion of the cycle and this pressure could become very high. One of the present problems with such fuel injectors is a need to prevent leakage around the valve which controls the passage of fuel into and out of the timing chamber. Various attempts have been made to alleviate this problem but few have been fully satisfactory due to the large pressure values. One solution uses a sliding valve and is taught in U.S. Pat. Nos. 4,235,374 and 4,281,792. However, the use of such a slide valve does not substantially solve the leakage problem. In addition to providing a low pressure seal to prevent leakage of fuel from the timing chamber during high pressure situations, there is also a need to create a seal which exerts a minimum amount of drag force on the valve as it rapidly reciprocates between an open and a closed position. Now a sealing arrangement has been invented which will satisfy these needs.

SUMMARY OF THE INVENTION

Briefly, this invention relates to a low pressure sealing arrangement which includes a housing containing a cylindrical barrel therein. An inner surface of the housing cooperates with an outer surface of the barrel to form an annular cavity therebetween. The barrel also contains an axial bore in which are positioned a plunger and a piston which are spaced apart from each other. Located at one end of the bore is a nozzle which releases fuel into the combustion chamber of an engine. Defined within the bore between the plunger and the piston is a timing chamber and defined within the bore between the piston and the nozzle is a metering chamber. Passages are arranged in the housing and in the barrel for routing pressurized fuel to the timing chamber, to the metering chamber and to opposite ends of the annular cavity. A control valve is positioned across one of the passages for varying the flow of pressurized fuel to one end of the annular cavity. Within the annular cavity is arranged a pressure activated valve which is movable between an open position permitting fluid flow from the pressurized source into the timing chamber and a closed position preventing fluid flow from the pressurized source into the timing chamber. Also arranged concentrically about the pressure activated valve and within the annular cavity is a cylindrical sleeve. The inner surface of the cylindrical sleeve contacts the outer surface of the pressure activated valve and forms a first low pressure seal therewith. In addition, an end of the cylindrical sleeve is biased against a surface of the annular cavity to form a second low pressure seal therewith. The first and second seals prevent leakage of pressurized fluid out of the timing chamber while permitting rapid reciprocal movement of the pressure activated valve between its open and closed positions.

The general object of this invention is to provide a low pressure sealing arrangement for a fuel injector. A more specific object of this invention is to provide a low pressure sealing arrangement for a fuel injector which will permit a pressure activated valve to reciprocate between its open and closed position while exerting a minimal amount of drag forces thereon.

Another object of this invention is to provide a low pressure sealing arrangement for a fuel injector which will reduce the number of precision parts needed in its construction.

Still another object of this invention is to provide a low pressure sealing arrangement for a fuel injector which is simple and economical to build.

Other objects and advantages of the present invention will become more apparent to those skilled in the art in view of the following description and the drawings.

DETAILED DESCRIPTION OF THE PREFERRED EMBODIMENT

Figure 1:
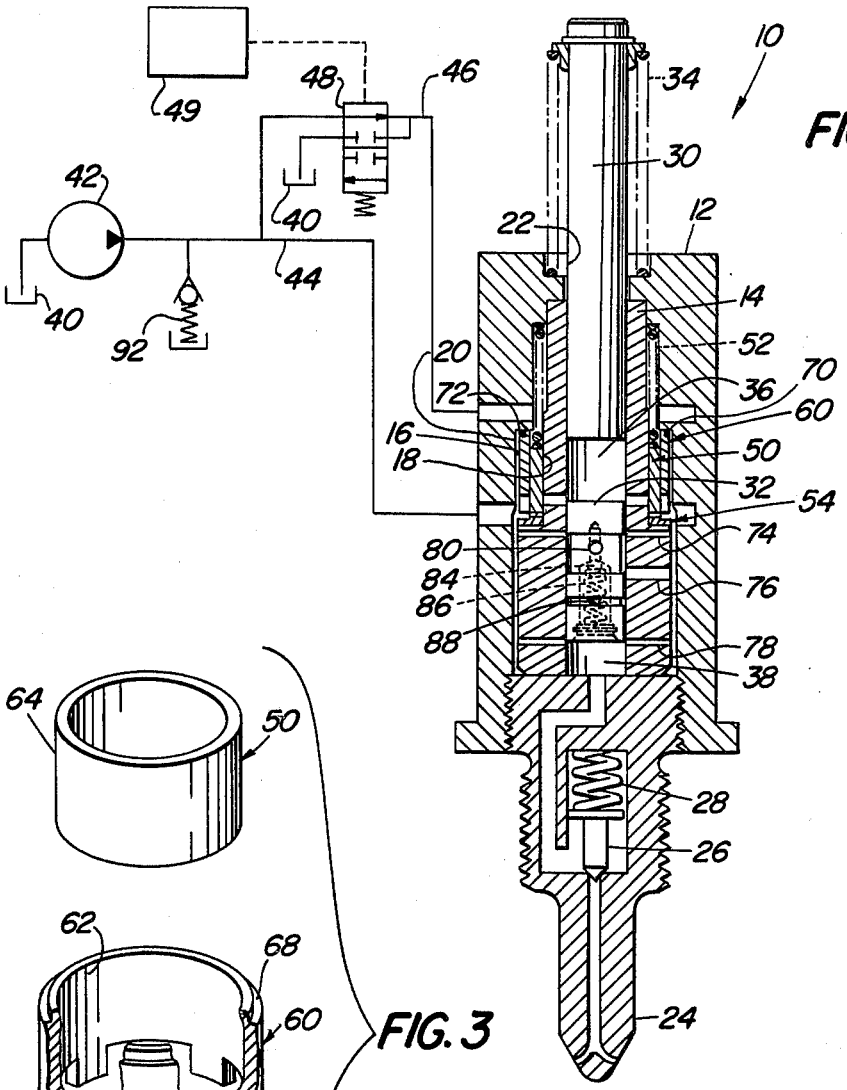
FIG. 1 is a sectional view of a fuel injector having the low pressure sealing arrangement.

Referring to FIG. 1, a fuel injector 10 is shown having a housing 12 enclosing a cylindrical barrel 14. An inner surface 16 of the housing 12 cooperates with an outer surface 18 of the cylindrical barrel 14 to form an annular cavity 20, the purpose of which will be explained shortly. Formed within the cylindrical barrel 14 is a bore 22, one end of which communicates with a nozzle 24 attached to an end of the housing 12. The nozzle 24 contains a poppet valve 26 which is biased to a closed position by a spring 28 to prevent fluid flow out of the nozzle 24 and into the combustion chamber of the engine. The poppet valve 26, preferably a differential area needle valve, is opened by an increase of pressure unseating the valve 26 against the bins of the spring 28 to thereby allow fluid to flow through the nozzle 24 and into the combustion chamber of the engine.

Movably positioned within the bore 22 is a plunger 30 and a piston 32 which are spaced apart from each other. The plunger 30 is mechanically driven from the camshaft of the engine, typically by a rocker arm mechanism, a cam and a cam follower, none of which are shown since they are well known to those skilled in the fuel injection art. The plunger 30 is biased upwardly by a spring 34 and is depressed downward into the housing 12 by the movement of the mechanically driven mechanism operated off the camshaft. Defined within the bore 22 between the plunger 30 and the piston 32 is a timing chamber 36 and defined within the bore 22 between the piston 32 and the nozzle 24 is a metering chamber 38. The timing chamber 36 controls the time at which fuel is injected through the nozzle 24 into the combustion chamber of the engine while the metering chamber 38 controls the amount of fuel which is actually injected into the combustion chamber.

Fuel to be injected from the fuel injector 10 is retained in a reservoir 40 and is pressurized by a pump 42. From the pump 42, the pressurized fluid passes through a first passage 44 which is formed in both the housing 12 and the barrel 14 and directs the fluid into the timing chamber 36. In so doing, the first passage 44 intersects the annular cavity 20 at a lower end. A second passage 46 branches off the first passage 44 downstream of the pump 42, and passes into the housing 12. This second passage 46 terminates at an upper end of the annular cavity 20. A control valve 48 is positioned across the second passage 46 and is operable by a control mechanism 49 between a first and a second position. In the first position, pressurized fluid from the pump 42 is allowed to flow through the second passage 46 to the upper end of the annular cavity 20 while in the second position, the flow of pressurized fluid from the pump 42 is blocked and instead the second passage 46 is connected to the reservoir 40. While the control valve 48 is in the second position, pressurized fluid in the upper end of the annular cavity 20 is capable of being drained to the reservoir 40.

Figure 3:
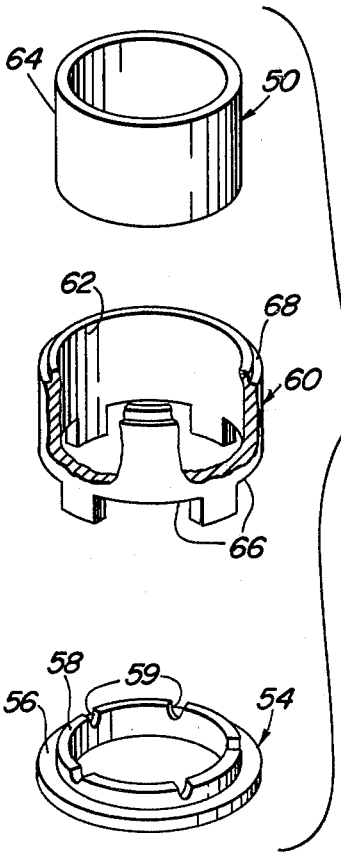
FIG. 3 is an exploded view of the pressure activated valve, the cylindrical sleeve, and a stop plate, depicted in FIG. 1.
Figure 2:
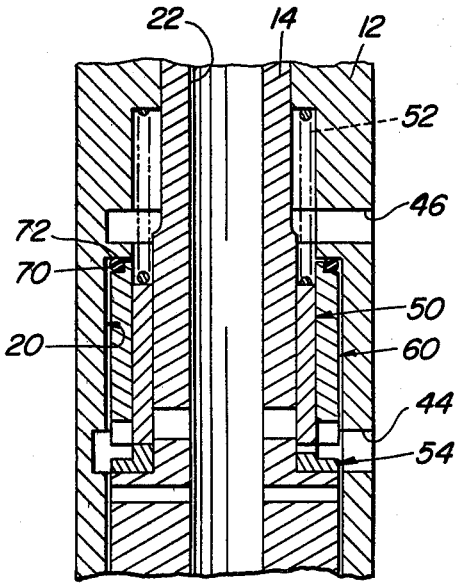
FIG. 2 is an enlarged sectional view of a portion of the low pressure sealing arrangement shown in FIG. 1 with the plunger and piston removed.

Arranged within the annular cavity 20 is a pressure activated valve 50 which is biased downwards to a closed position by a spring 52, see FIG. 2. The pressure activated valve 50 is a cylindrical sleeve which reciprocates between an open and a closed position permitting or blocking the flow of pressurized fluid through the first passage 44 and into the timing chamber 36. The pressure activated valve 50 abuts a stop plate 54 when in a closed position. The stop plate 54, best seen in FIG. 3, is a ring-shaped device having a stepped configuration thereby creating an intermediate surface 56 and a top surface 58. When the pressure activated valve 50 is in its closed position, its bottom surface rests upon the top surface 58 of the stop plate 54. The stop plate 54 also contains a plurality of semi-circular grooves or openings 59 formed in the top surface 58 which permit fluid from the first passage 44 to flow therethrough and impinge on the underside of the pressure activated valve 50. Also located within the annular cavity 20 and concentrically arranged about the pressure activated valve 50 is a cylindrical sleeve 60. The cylindrical sleeve 60 contains an inner surface 62 which surrounds an outer surface 64 of the pressure activated valve 50 thereby forming a first seal with the pressure activated valve 50. When assembled, the bottom end of the cylindrical sleeve 60 will rest on the intermediate surface 56 of the stop plate 64. In addition, the cylindrical sleeve 60 preferably contains a plurality of notches 66 on its bottom end surface which abuts the stop plate 54 so as to allow fluid to flow into the semi-circular grooves 59 and under the cylindrical sleeve 60. Formed about the opposite or upper end of the cylindrical sleeve 60 is a shoulder 68 which supports an O-ring seal 70. The O-ring seal 70 abuts against a downwardly facing surface 72 of the annular cavity 20 and forms a second low pressure seal therewith. When assembled the cylindrical sleeve 60 will be urged upwards by fluid pressure such that the O-ring seal 70 forms a seal against the surface 72. However, it should be noted that if the pressurized fluid on the bottom surface of the cylindrical sleeve 60 is insufficient to form such a seal, a spring or other type of biasing means could be inserted between the cylindrical sleeve 60 and the stop plate 54 to assure a positive seal at the upper end.

Referring again to FIG. 1, the fuel injector 10 also contains three additional passages denoted as 74, 76 and 78 which are formed in the cylindrical barrel 14 below the first passage 44. The passage 74 is of a very small diameter and permits fluid flow out of the timing chamber 36 when the piston 32 is at the bottom of its stroke. By having the passage 44 located as shown in FIG. 1, trapped fluid in the timing chamber 36 can be relieved without causing damage to the plunger 30 or to its control mechanism. The passage 76 is located below the passage 74 and serves to direct pressurized fluid to the metering chamber 38. Pressurized fluid flowing through the passage 76 passes through a first port 80 which communicates with a central bore 82 formed within the piston 32. The pressurized fluid depresses a check ball 84 biased to a closed position by a spring 86 and flows through the central bore 82 to the metering chamber 38. The third passage 78 is also of a small diameter such as the passage 74 and serves to allow fluid to flow out of the central bore 82 of the piston 32 when the piston 32 reaches the bottom of its stroke. Fluid trapped between the poppet valve 26 and the bottom of the piston 32 will flow back out of a second port 88, and around a groove 90 and out through the passage 78. The second port 88 and the groove 90 are machined into the piston 32 below the first port 80. It should be noted that a relief valve 92 such as a spring-loaded check ball can be placed in communication with the first passage 44 to prevent the buildup of excessive pressure within this line.

OPERATION

Starting from a position wherein the plunger 30 and the piston 32 are both at the bottom of their stroke and the pressure activated valve 50 is in a down or closed position, the sequence of operation is as follows. The control valve 48 is in its first position allowing pressurized fluid to flow from the pump 42 through the second passage 46 to the top of the annular cavity 20 while additional pressurized fluid flows through the first passage 44 to the bottom of the annular cavity 20. Since the pressure on the top and bottom of the pressure activated valve 50 is equal, the spring 52 will be able to retain the pressure activated valve 50 in its down or closed position. At this time, the pressurized fluid in the first passage 44 is directed through the passage 76 and the port 80 into the piston 32. This fluid will depress the check ball 84 against the spring 86 and enter into the metering chamber 38.

As the plunger 30 moves upward via the force of the spring 34, the piston 32 will do likewise expanding the metering chamber 38 thereby allowing additional fluid to flow into it. At a preselected point, wherein a measured amount of fluid is present in the metering chamber 38, the control valve 48 is moved by a signal from the control mechanism 49 to its second position wherein incoming pressurized fluid from the pump 42 is blocked while the pressurized fluid presently in the second passage 46 is allowed to drain to the reservoir 40. When this happens, the forces impinging on the top of the pressure activated valve 50 will be reduced to a value less than the pressurized fluid impinging on the bottom of the pressure activated valve 50. This permits the pressure activated valve 50 to move upwards and allow fluid flow through the first passage 44 and into the timing chamber 36. At this point, the pressurized fluid acting on both the top and bottom surfaces of the piston 32 will be neutralized and the piston 32 will assume a stationary position. The plunger 30 will continue to move upward thereby allowing pressurized fluid to enter the timing chamber 36 until the cam and rocker arm mechanism exert downward pressure on the plunger 30 which overcomes the force of the spring 34. As the plunger 30 starts its downward stroke, the fluid in the timing chamber 36 will be pushed back out of the first passage 44 until a desired time for injection occurs. This outward flow of fluid will flow backwards through the first passage 44 and out through the relief valve 92 if it should rise above a predetermined value.

At the desired time, the control mechanism 49 allows the control valve 48 to move back to its first position wherein pressurized fluid is allowed to flow from the pump 42 to the upper end of the annular cavity 20. This action neutralizes the force of the pressurized fluid impinging on the bottom surface of the pressure activated valve 50 and permits the spring 52 to force the pressure activated valve 50 downward to the closed position. This blocks off all further fluid flow into or out of the timing chamber 36. When this occurs, a hydraulic coupling or link is formed by the fluid in the timing chamber 36 so that the piston 32 will move in unison with the plunger 30. As the plunger 30 moves downward, the pressure of the fluid within the timing chamber 36 will increase and impinge on the inner surface of the pressure activated valve 50. This increased pressure forces the outer surface 64 of the valve 50 firmly against the inner surface 62 of the cylindrical sleeve 60 thereby forming a positive seal therebetween. At the same time, the pressurized fluid in the first passage 44 will impinge on the lower surface of the cylindrical sleeve 60 and force it upward such that the O-ring seal 70 will abut against the end surface 72 of the annular cavity 20 and form a second low pressure seal therewith. These first and second low pressure seals are beneficial in preventing leakage of fluid out of the timing chamber 36 during the high pressure portion of the cycle. As the plunger 30 continues downward, the piston 32 will move likewise and force the fluid presently contained in the metering chamber 38 to impinge on the differential area poppet valve 26. As the poppet valve 26 rises, the fluid in the metering chamber 38 will flow through the nozzle 24 and into the combustion chamber of the engine. As the piston 32 approaches the bottom of its stroke, the port 88 will be brought into communication with the passage 78 thereby allowing fluid to flow out of the metering chamber 38 and prevent damage to the piston 32. Likewise, fluid in the timing chamber 36 will be brought into communication with the passage 74 and will be able to flow outward in a similar fashion. This completes one full cycle of the fuel injector 10.

It should be noted that while the low pressure sealing arrangement of this invention has been described with a particular fuel injector, it can also be used in other types of injectors to prevent leakage of fuel out of either the timing chamber, the metering chamber or to prevent leakage of fuel out of both chambers.

While the invention has been described in conjunction with a specific embodiment, it is to be understood that many alternatives, modifications, and variations will be apparent to those skilled in the art in light of the aforegoing description. Accordingly, this invention is intended to embrace all such alternatives, modifications, and variations which fall within the spirit and scope of the appended claims.

I claim:

1. A low pressure sealing arrangement for a fuel injector comprising:

(a) a housing containing a cylindrical barrel therein and having an annular cavity formed between an inner surface of said housing and an outer surface of said barrel, said barrel also having a bore formed therein;

(b) a plunger and a piston spaced therefrom, said plunger and piston being positioned within said bore for axial movement;

(c) a nozzle situated at one end of said bore remote from said plunger for releasing fuel into a combustion chamber of an engine;

(d) a timing chamber defined in said bore between said plunger and said piston being adapted to receive pressurized fluid for creating a coupling between said plunger and said piston;

(e) a metering chamber defined in said bore between said piston and said nozzle;

(f) passages formed in said housing and said barrel for receiving pressurized fluid and transmitting said fluid into said timing chamber, into said metering chamber and into opposite ends of said annular cavity;

(g) control means for varying the flow of pressurized fluid through one of said passages and into one of said annular cavity;

(h) a pressure activated valve arranged in said annular cavity and movable by fluid pressure between an open position permitting fluid flow from said pressurized source into said timing chamber and a closed position preventing fluid flow from said pressurized source to said timing chamber;

(i) a cylindrical sleeve concentrically arranged about said pressure activated valve within said annular cavity for providing a first low pressure seal against an outer surface of said pressure activated valve; and (j) means for axially urging an end of said cylindrical sleeve against a surface of said annular cavity to provide a second low pressure seal therewith, said first and second seals preventing leakage of fuel from said timing chamber during periods of increased pressure while permitting rapid movement of said pressure activated valve between said open and closed position with a minimal amount of drag forces acting thereon.

2. The low pressure sealing arrangement of claim 1 wherein said cylindrical sleeve contains a plurality of notches formed about the periphery of one of its ends for facilitating the passage of pressurized fluid therethrough.

3. The low pressure sealing arrangement of claim 1 wherein said cylindrical sleeve contains an annular groove for supporting said second seal.

4. The low pressure sealing arrangement of claim 1 wherein a stop plate is positioned at one end of said annular cavity, said stop plate containing a plurality of openings therein for permitting fluid to get under one end of said pressure activated valve.

5. The low pressure sealing arrangement of claim 1 wherein said pressure activated valve controls the flow of pressurized fuel into said timing chamber thereby creating a hydraulic link between said plunger and said piston when in a closed position to selectively couple said plunger to said piston.

* * * * *

UNITED STATES PATENT AND TRADEMARK OFFICE

CERTIFICATE OF CORRECTION

PATENT NO. : 4,393,847

DATED : 19 July 1983

INVENTOR(S) : Charles W. May

It is certified that error appears in the above-identified patent and that said Letters Patent is hereby corrected as shown below:

Column 6, line 37, after "one", second occurrence, insert -- end --.

Signed and Sealed this

*Third* Day of *January 1984*

[SEAL]

*Attest:*

GERALD J. MOSSINGHOFF

*Attesting Officer*

*Commissioner of Patents and Trademarks*